US008677897B2

(12) United States Patent
Vogt

(10) Patent No.: US 8,677,897 B2
(45) Date of Patent: Mar. 25, 2014

(54) PAD PRINTING MACHINE

(75) Inventor: Udo Vogt, Rottenburg (DE)

(73) Assignee: ITW Morlock GmbH, Dornstetten (DE)

( * ) Notice: Subject to any disclaimer, the term of this patent is extended or adjusted under 35 U.S.C. 154(b) by 408 days.

(21) Appl. No.: 12/937,599

(22) PCT Filed: Jun. 17, 2009

(86) PCT No.: PCT/IB2009/052588

§ 371 (c)(1),
(2), (4) Date: Oct. 13, 2010

(87) PCT Pub. No.: WO2009/153743

PCT Pub. Date: Dec. 23, 2009

(65) Prior Publication Data

US 2011/0023738 A1 Feb. 3, 2011

(30) Foreign Application Priority Data

Jun. 19, 2008 (DE) ..... 10 2008 029 300

(51) Int. Cl.
*B41F 17/00* (2006.01)
*B41F 1/28* (2006.01)

(52) U.S. Cl.
USPC ..... 101/41; 101/407.1; 101/474

(58) Field of Classification Search
USPC ..... 101/41–44, 123, 126, 129, 407.1, 474
See application file for complete search history.

(56) References Cited

U.S. PATENT DOCUMENTS 5,031,334 A 7/1991 Takamura
5,134,932 A 8/1992 Fujino
5,136,948 A * 8/1992 Fujino et al. ..... 101/486
5,383,398 A * 1/1995 Binnen ..... 101/41
5,662,041 A * 9/1997 Kleist ..... 101/163
5,752,446 A * 5/1998 Squibb ..... 101/486
5,899,143 A 5/1999 Niestrath et al.
6,338,297 B1 * 1/2002 Wang et al. ..... 101/126

(Continued)

FOREIGN PATENT DOCUMENTS

DE 3904863 A1 8/1990
DE 29605123 U1 7/1997

(Continued)

OTHER PUBLICATIONS

ISR for PCT/IB2009/052588 mailed Nov. 13, 2009.
German Search Report for 10 2008 029 300.8 dated Jan. 1, 2009.

*Primary Examiner* — Ren Yan
(74) *Attorney, Agent, or Firm* — Lowe Hauptman & Ham LLP

(57) ABSTRACT

A pad printing machine including at least one pad holder and an object carrier which is positionally displaceably relative to the pad holder and is designed to receive one or more objects, where said pad printing machine further comprises a setup print image receiving element at a fixed distance from the object carrier, further an image recorder to generate an image of at least one zone of the setup print image receiving element, a position deviation detector ascertaining the deviation of the actual position of a print image situated on the print image receiving element from a reference position defined by reference data, and a position shift ascertaining element to ascertain the shift of the object carrier relative to a reference position, as well as a method for printing objects using a pad printing machine.

16 Claims, 3 Drawing Sheets

(56) References Cited

U.S. PATENT DOCUMENTS

Figure 1:
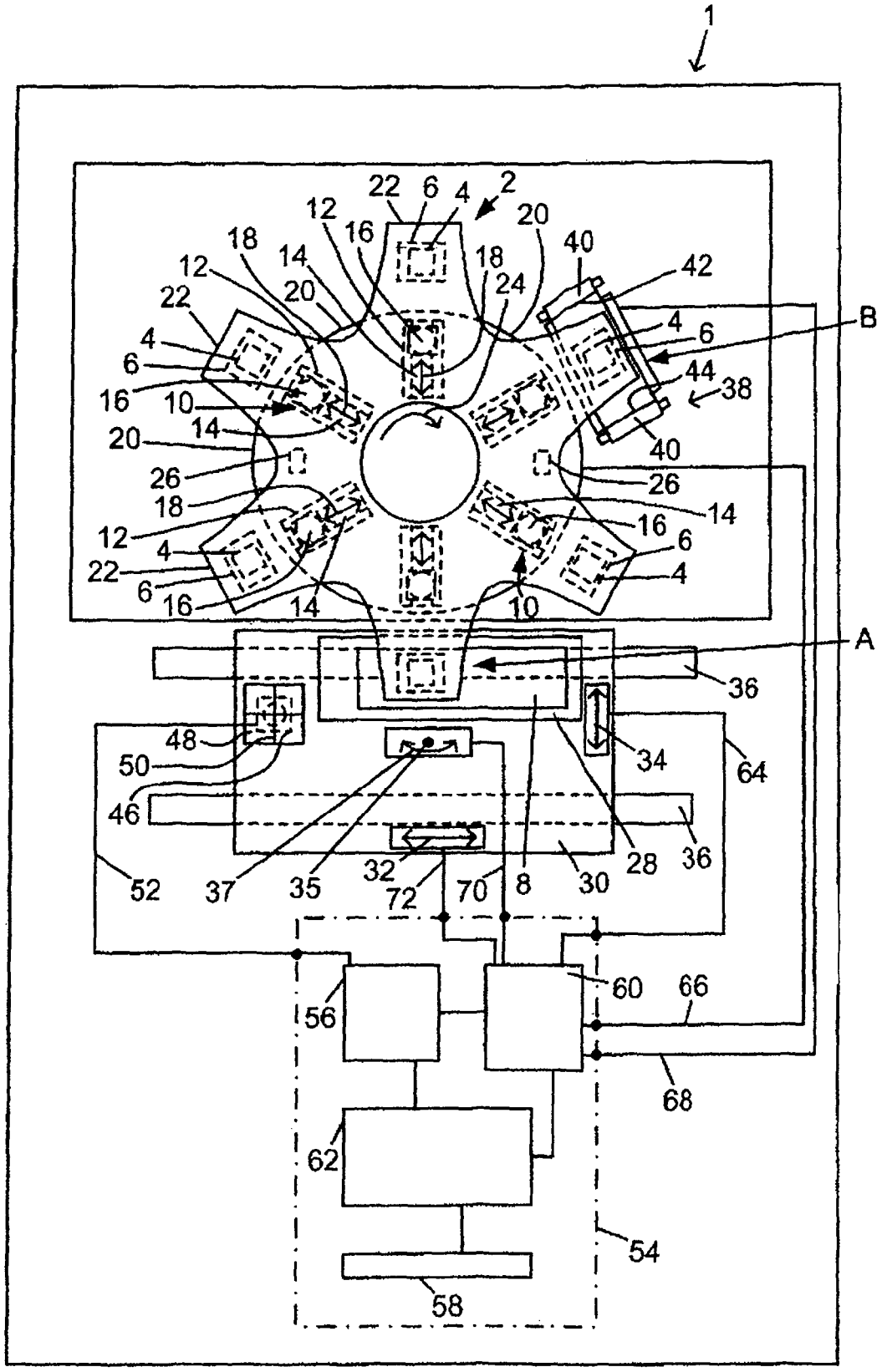

| | | | | |
|---|---|---|---|---|
| 6,393,981 | B1 | 5/2002 | Cameron | |
| 6,499,367 | B1 * | 12/2002 | Saeki | 73/865.9 |
| 7,658,146 | B2 * | 2/2010 | Reinholdt | 101/163 |
| 7,908,964 | B2 * | 3/2011 | Yamasaki et al. | 101/126 |
| 2003/0121427 | A1 | 7/2003 | Lampinski et al. | |
| 2006/0065137 | A1 | 3/2006 | Nguyen et al. | |

FOREIGN PATENT DOCUMENTS

| | | | |
|---|---|---|---|
| DE | 19614740 | A1 | 10/1997 |
| DE | 102005060550 | A1 | 6/2007 |
| EP | 0379447 | A1 | 7/1990 |
| GB | 2260729 | A | 4/1993 |
| WO | WO 02097534 | A2 * | 12/2002 |
| WO | 2005/068199 | A1 | 7/2005 |

* cited by examiner

PAD PRINTING MACHINE

RELATED APPLICATIONS

The present application is national phase of PCT/IB2009/052588 filed Jun. 17, 2009, and claims priority from, German Application Number 10 2008 029 300.8 filed Jun. 19, 2008.

The present invention relates to a pad printing machine defined in the preamble of claim 1 and to a method defined in the preamble of claim 9 for printing an object using a pad printing machine.

Pad printing machines illustratively are known from the patent documents U.S. Pat. No. 6,393,981 B1; EP 0 379 447 A1 and DE 10 2005 060 550. Pad printing machines are known both for printing objects in a single color (one-step printing) and for printing them in multiple colors (multi-stage printing), as well as pad printing machines used for multi-stage printing and/or printing in segments (multi-segment printing) objects. As regards the printing machine of the German patent document 10 2005 060 550 for instance, one printing unit carrier supports several pad printing units. Such a plurality of printing units allows multi-stage printing an object by just one machine, where, besides the feasibility of multi-ink printing such as printing using a red ink in the first printing stage and a black ink in a second or a further printing stage, multi-stage printing with a single color also is possible.

Furthermore there are pad printing machines used in particular to print segment-wise, i.e., several segments of (typically large) objects, for instance dishwasher, clothes washers or for other large objects' decorations. Pad printing machines for instance fitted with six pads are especially appropriate for such multi-stage, i.e., multi-segment printing, said pads together with their particular pad holders being configured on a rotary disk printing unit carrier and being moved into a printing position to print the given object. Such pad printing machines usually are fitted with a position-variable object carrier receiving said object to be printed which in this manner can be positioned accurately.

There is a time-consuming procedure, which often entails production malfunction, in particular as regards multi-stage and/or multi-segment printing, namely the setup of the proper position of the print image, especially the registering of the print images of various printing stages relative to each other, in order to attain the desired composite image. The setup procedure is required not only when initially registering a print image, but also subsequent to a change in components illustrative due to wear, for instance one/the printing pads and/or the printing plate, or following exchanging the said object carrier, due to printing resumption for a given object where previously an object of another shape had been printed (the so-called retrofit). Heretofore all setup procedures have been carried out manually, that is, as a rule, an object is fitted with a protective foil and a test print is deposited. Next the printing machine is manually registered using said test print until the printed image assumes the desired position. The same procedure takes place subsequently at each of the ensuing printing stages for each ensuing print segment.

In particular, subsequently to an initial orientation, it would be desirable—for instance in the case of a wear-induced change of components such as the printing pad and/or the printing plate—to have access to a printing machine wherein the proper position(s) of the print image(s) would be re-registered again simply and quickly.

Accordingly it is the objective of the present invention to create a pad printing machine to print objects and making it possible to a user, for instance after exchanging a component or components, to properly re-position, e.g., re-register, in simple manner a printed image, e.g., the printed images of the various printing stages, e.g., the various print segments. Another objective of the present invention is a corresponding method to print such an object using a pad printing machine, said method of the present invention being simpler than previously used procedures.

The equipment aspect of said objective of the present invention is defined by a pad printing machine having the features of claim 1, whereas the procedural aspect is attained by a method defined in claim 11.

Further features of the present invention are defined in the dependent claims.

The present invention is discussed in illustrative manner below in relation to the drawings showing illustrative embodiment modes.

Figure 2:
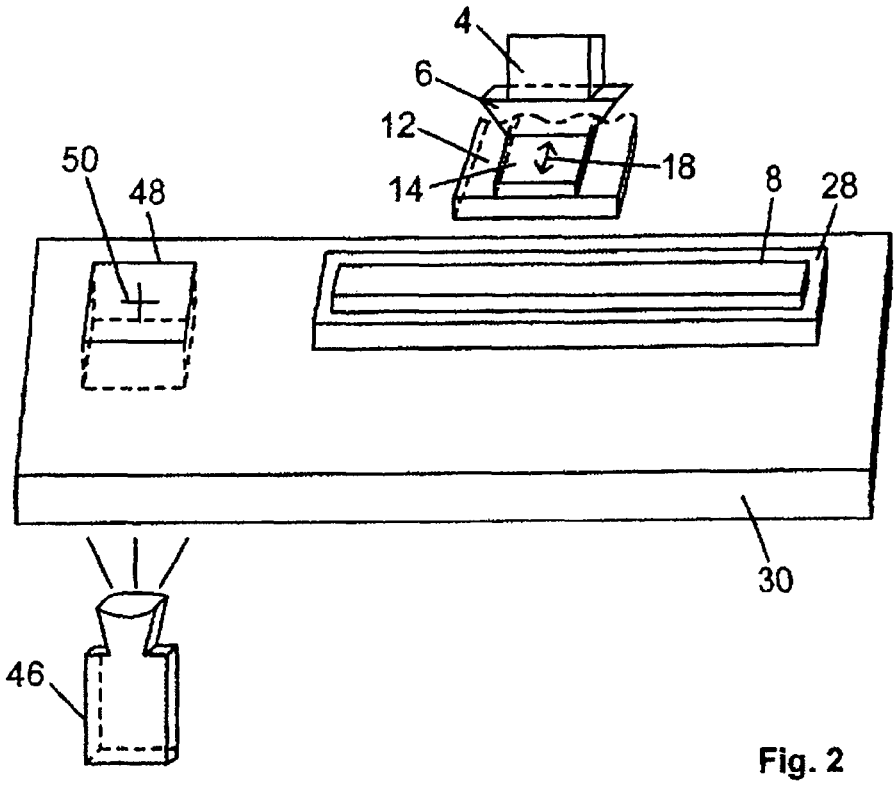
Figure 3:
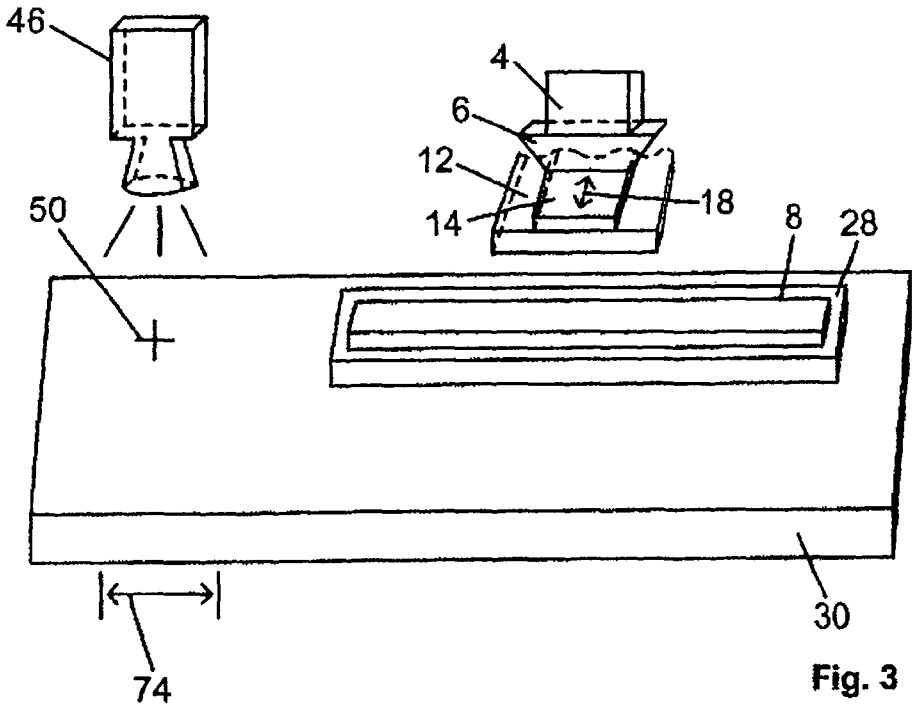
Figure 4:
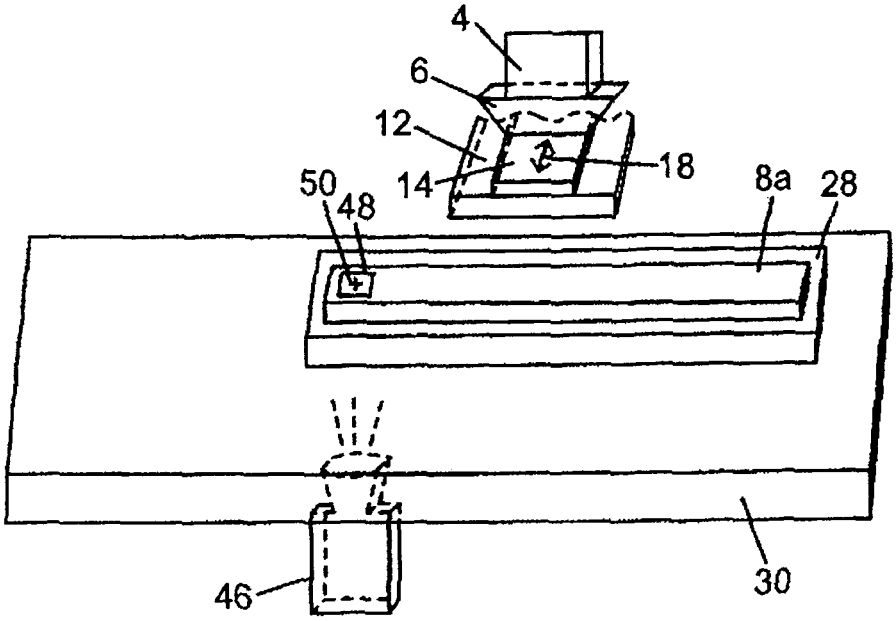

FIG. 1 schematically shows a top view of a pad printing machine of a first embodiment of the present invention, FIG. 2 is a partial perspective of a first preferred embodiment mode, FIG. 3 shows a second preferred embodiment mode of a pad printing machine of the invention in a view similar to that of FIG. 2, and FIG. 4 shows a third preferred embodiment mode of a pad printing machine of the invention in view similar to that of FIGS. 2 and 3.

As shown by FIG. 1, the pad printing machine 1 comprises a printing unit support 2 to which is affixed a plurality (two or more) of pad holders 4 (six in the discussed first preferred embodiment mode). One printing pad 6 is affixed to each pad holder 4. The printing unit carrier 2 displaces the pad holders 4 and the pads 6 affixed to them along a loop to a print image application position A (printing station) where an object can be or is being printed. Moreover the first preferred embodiment of the pad printing machine 1 of the invention comprises six printing plate zones 10 corresponding to the six printing pads 6, said zones each fitted with a printing unit support 12 receiving a (preferably flat) printing plate 14.

A printing image is constituted in one or more recess(es) in each case on the upward pointing surface of each printing plate 14. The print image also may be fitted with special markings to position it, namely the so-called register marks. The printing image in each case is situated below an ink cup 16 which is fitted with a downward cup edge in the form of a doctor blade and rests on the upward-pointing surface of the printing plate. The printing image is situated underneath the ink cup 16 and within said cup's rim, as a result of which ink is able to enter the recess(es) of the printing image but is precluded from escaping out of the ink cup 16 at the doctor's edge. The ink cup also protects the printing image from drying. Inclusive the doctor blade, the ink cup 16 also may be operated in controlled manner, so that it shall selectively move over to, e.g., scrape the print image with or without register marks. The recess(es) representing the printing image at its/their surface(s) may be made, by etching or other techniques, in the printing plate 14.

The printing plate zones 10, the printing plate supports 12 and the printing plates 14 are configured on a rotary disk 20 rotatable about a central, vertical center axis (indicated by the arrow 24). In the described first preferred embodiment mode shown in FIG. 1, the printing unit carrier 2 is also a rotating structure in the form of a rotary disk, e.g., a rotary table or a turnstile 22, rotating about the same vertical center axis (also denoted by the arrow 24). The printing unit carrier 2 in the form of a rotary disk, e.g., a turnstile, is frictionally and operationally linked by elements 26 to the rotary disk 20, as a result of which both the rotary disk 20 and the turnstile 22 are simultaneously rotating about the central and vertical axis.

A drive fitted with a force generator, preferably a pneumatic or hydraulic or electric force generator such as an electric motor, is used to actuate the rotary disk 20 and the turnstile 22. The rotary disk 20 and the lazy susan turnstile 22 can be rotated by said drive in a constant direction of rotation by at least 360° or preferably by an arbitrary number of turns beyond 360° in the same direction of rotation. Conceivable and alternative embodiment modes include rotatibility of the rotary disk 20 and the lazy susan turnstile 22 in both possible directions of rotation (namely in the direction of the arrow 24 and opposite to it). In the latter design the rotary disk 20 and the lazy susan turnstile 22 are rotated by predetermined angular units. As regards the said first preferred embodiment mode, the drive is in steps, for instance being an electrical stepping motor, with an adjustable number of displacement steps required to rotate the rotary disk 20, e.g., the lazy susan turnstile 22, farther each time by one angular unit.

In the above described embodiment mode, the position A is the print image transfer position wherein the particular printing pad 6 comes to rest against at least a portion of the printing late 14 and picks up ink from its (print image) and then transfers this collected ink onto the object 8. For that purpose the printing plate carrier 12 (indicated by the double arrow 18) is moved forward underneath the immobile ink cup 16 and underneath the printing pad 6 and then is displaced from a rest position downward onto the printing plate 14. Next the printing pad 6 is moved upward and the printing plate 14 is again moved rearward (as indicated anew by the double arrow 16). After the printing pad 6 has picked up its ink, it is moved down onto the object 8 in latter's ready-to-be-printed position, and the printing image is deposited on the object 8.

In order to print the object 8 in multiple stages and/or in multi-segmented manner (a combination of multiple stage and multiple segment printing is also feasible using the first preferred embodiment mode), the object 8 is configured on an object support 28 which in turn is configured on a multi-position table 30. The multi-position table 30 is displaceable both in an x-direction (indicated by the double arrow 32) and in a y-direction (indicated by the double arrow 34). Again the multi-position table 30 may change its angular position relative to the multi-position rails 36 on which it is mounted (by being rotated about an axis of rotation 35 vertical to the multi-position table as indicated by a double arrow 37), as a result of which the object 8 on the object carrier 28 can be moved into the desired printing position. In an alternative embodiment mode of a pad printing machine 1 of the present invention, the multi-position table 30 might be rotatable about one or more possible other axes of rotation and also be displaceable in further possible directions. Again several (two or more) objects may be resting on the object carrier 28. Illustratively too, single-stage and single-segment printing may be applied to six identical or different objects 8 resting on the said object carrier.

Besides the print image transfer position A (print image transfer station) there is a further operational position, namely a cleaning position B associated with a cleaning system 38. The cleaning system comprises two roll supports 40, 40*a*. A cleaning band dispensing roll 42 may be/is mounted on the first roll support 40 and dispenses fresh, e.g., unused cleaning, band. A cleaning band receiving roll 44 winding up the used cleaning band is mounted on the second roll support 40*a*. It is understood that the two rolls may be configured inversely too, that is, the cleaning band receiving roll may be mounted on the roll support 40 and the cleaning band dispensing roll may be mounted on the roll support 40*a*. A cleaning band is guided at a predetermined rate between the two rolls 42, 44 and underneath the printing pad 6 which is situated in the cleaning position B. To carry out cleaning, the printing pad 6 situated in the cleaning position B is displaced out of its rest setting/position downward into a cleaning position in a manner that its "active" surface—namely the surface carrying the print image when printing the object—comes into contact with said cleaning band (for instance being pressed against the cleaning band).

To facilitate setup, e.g., repeated setup of the print image when exchanging worn parts, e.g., when again printing following interruption (for instance due to printing another object 8), an image recorder 46 in the form of a CCD camera is configured underneath the multi-position table 30 in a fixed position relative to the multi-position table 30 in the above described first preferred embodiment mode of the pad printing machine 1. It is understood any image recording device other than a CCD camera may also be used, for instance a video camera, a conventional digital camera, also a camera illustratively operating in the invisible range of wavelengths such as an IR or an UV camera. In the above described preferred embodiment mode the camera is connected by means of an appropriate camera support with the multi-position table 30. Alternatively and obviously, one might also use a mechanism simultaneously displacing the camera with the multi-position table along the various directions.

The image recorder 46 is configured in a manner that it is capable of imaging at least segments/portions of a setup print image receiving element 48 in the form of a glass plate integrated into the multi-position table 30. The setup print image receiving element 48 bears a position marker, e.g., a setup mark 50 in the form of etched crosshairs. Alternatively to such etched crosshairs any other marker might be used, illustratively a printed marker or also a milled marker or one made in another way. Markers other than crosshairs also may be circular, rectangular or of other geometries as well.

The register mark 50 is configured on the side of the glass plate 48 facing the printing pad 6, whereas the camera is configured underneath the multi-position table 30, that is, on the glass plate's side away from the printing pad 6, and looks at this latter side.

The image recorder 46 is connected by a communication line 52 with a control unit 54 driving the pad printing machine 1. The data from the image recorder 46 are transmitted within the control unit 54 to a positional deviation detector 56 to ascertain the position differential between an image recorder's image and a reference image, i.e., reference data. Besides the differential position detector 56, the control unit also comprises a memory 58, a position-shift sensor 60 determining a positional shift of the multi-position table 30 (by means of communication conductors 64, 70, 72) and hence of the object carrier 28 relative to a given/fixed position, for instance a reference position. Control of the multi-position table 30 as well as of the printing unit support 2 is implemented by a component control unit 62 which on one hand (being internally wired) communicates with the above cited components and on the other hand by means of the communication lines 64, 66, 68, 70, 72 with the multi-position table 30, the printing unit support 2 and the cleaning system 38. In alternative embodiment modes, the component control unit 62 is fitted with a joystick to manually position the object carrier 28, or is designed to displace the object carrier 28 by means of keypad inputs. The listing just above of the components of the control unit 54 is left incomplete, many others actually being present within it that are required to control the other components of the pad printing machine 1. The present patent application discusses only some of the machine's components.

The (renewed) setup or registering of the pad printing machine of the present invention—for instance following exchanging worn components such as the printing pad 6 or the printing plate 14, but also in particular following an exchange of the object carrier [reset]—is implemented by a method of the present invention to print an object 8 with resort to reference data which, in the above described preferred embodiment mode are collected during or following the initial registering of the pad printing machine 1. In the preferred implementing mode of a method of the present invention, said reference data include a reference position shift and an image of a reference setup print image (generated by the image recorder 46), where said reference positional shift is the shift of the object carrier 28 between a reference print image (e.g., an optimal setup position for applying the print image to object 8) and a setup print image (e.g., a transfer position for the reference setup print image as determined by the positional shift sensor 60).

To register the pad printing machine 1 again the control unit 54 is switched to a special "startup" mode wherein the object carrier 28 is moved into a print image transfer setup position for each printing stage, e.g., each print segment. In that print image setup position, the particular printing pad 6 shall be situated above the setup print image receiving element in the form of the glass plate 48. Thereupon the print image is transferred to the setup print image receiving element (glass plate 48) by lowering the printing pad 6 in a manner that it shall come into contact with said glass plate and shall transfer a setup print image. Next an image of the setup print image situated on the setup print image receiving element 48 is recorded by the image recorder 46. The generated image is compared with that of the reference setup print image, and a deviation of the position of the setup print image from the position of the reference setup print image is detected by the position deviation detector 56.

On the basis of the data acquired in this manner, the object carrier 28 may be moved into a print image application position representing that position in which the object 8 shall be positioned optimally relative to the printing pad 6. This print image application position is determined taking into account the shift in reference position and the deviation between the position of the setup print image and the position of the reference setup print image. This determination is carried out by the control unit 54, which then shall commensurately control the multi-position table 34 and drive it into a print image application position. In alternative embodiment modes, positioning may be implemented manually by an operator using a joystick or a keypad and visually comparing the reference setup print image and the setup print image and correcting the position. Then the object 8 may be printed because the multi-position table 34 shall be in the position appropriate for printing. Such a procedure allows easily and simply correcting position variations for instance due to an exchange of components.

The determination of the deviation of the setup print image position from the position of the reference setup print image may be carried out by a comparison of the entire image and the reference image or by comparing prominent or preferred sites or partial zones, for instance, register marks, of the (setup) print image, where the ink cup 16 and the doctor blade scrape over the register marks on the printing plate 14 only when in the "startup" mode.

The discussion below relates to a second preferred embodiment mode (see FIG. 3) of a pad printing machine 1 of the present invention. In said second embodiment mode, and contrary to the case of the first, the image recorder 46 is configured not underneath the multi-position table 30, but above it. This feature allows simple manufacture, a good contrast may be attained when recording translucently. It is understood that the setup print image receiving element 48 need not be made of glass. The first preferred embodiment mode includes all transparent, e.g., semi-transparent materials, whereas the second preferred embodiment mode includes all materials. Nor is a setup print image receiving element 48 needed per se. In this instance a partial zone receiving element of the multi-position table 30 suffices, said zone serving as a setup print image receiving element.

The design of a third preferred embodiment mode of a pad printing machine 1 of the present invention (FIG. 4) is similar to those of the two embodiment modes already described above. Only the differences between said third embodiment mode and the above two shall be discussed below. Contrary to the case of the former two, in the third embodiment mode the setup print image receiving element 48 is firmly bonded into the master object 8*a* (alternatively the setup print image receiving element 48 may be deposited on the master object 8*a* or integrated into it). In this third embodiment mode the setup print image receiving element 48 consists of a transparent basic structure modeled on the master object 8*a* (of which the shape is identical with that of the subsequently printed objects 8) and again is fitted with an engraved or etched cruciform registry mark 50. In this manner a real and direct reference for the desired print image can be represented on the actual object to be printed 8, 8*a*. In this particular embodiment mode, this referencing is implemented from below by the image recorder 46 which is configured in exchangeable manner in a standard duct because the setup print image receiving element 48 is transparent (for that purpose the multi-position table 30 and the object carrier also are made of a transparent material at least at the corresponding zones or are fitted with recesses/apertures. Alternatively the image receiving element may be configured above the master object 8*a*, e.g., the object 8, in which case a register mark 50 also might be deposited on an opaque master object 8*a* (for instance being painted or bonded on it). In this way a nearly unchanged object 8 to be printed subsequently once might be used as the master object 8*a* and to deposit a register mark 50 by painting or bonding or similarly. Referencing then would ensue by bonding a cover foil, where during the repeated or renewed setup procedure the deviations following printing again on a cover foil can be determined and corresponding corrections must be carried out.

Besides configuring the image recorder 46 underneath or above the multi-position table 30 or a master object 8*a*, the setup print image receiving element 48 (transparent, opaque, with an arbitrary register mark 50) might also be configured at or on the object carrier 28.

Be it borne in mind that the present invention was discussed above in relation to a pad printing machine 1 designed for the multi-stage and/or multi-segment printing of objects 8. It is understood that the present invention is not restricted to multi-stage pad printing machines 1, e.g., such machines comprising several printing pads 6. Even pad printing machines fitted with one printing pad 6 and to be used for single stage, single segment printing, may be used within the scope of the present invention. This latter feature would be specially advantageous when many small runs must be printed with a single pattern.

The design of a fourth embodiment mode of the present invention of the pad printing machine 1 of the invention is similar to the above described embodiment modes.

As regards said fourth embodiment mode, the printing modules are configured in series linearly in a row. The pad supports 4 together with the pads 6 are mounted on the printing modules. The pad supports comprise a quick-connect element fitted with a stop for the pad.

A linear axle on which a carriage is displaceable along an x-axis between the printing module is configured underneath the printing modules. Said carriage is fitted with an object support displacing the object along a y-direction perpendicular to the x-axis and to a z-axis defined by the printing direction of the pad 6. Moreover a rotary device is mounted on said carriage allowing rotating said object in the x-y plane.

Each printing module is fitted with a printing plate which, in addition to a print image, also comprises special markings, so-called register marks having defined positions relative the print image.

An ink cup fitted with a doctor blade operates in controlled manner and therefore it may selectively run only over the print image or also over the register marks. The ink cup and the doctor blade may be driven electrically or pneumatically.

In addition to the printing modules, the pad printing machine also comprises an optical inspection station fitted with image recorders and illuminating means. The image recorders illustratively may be video or CCD cameras. Because of its linear axle, the carriage can be moved underneath the inspection station.

The method for printing objects using a pad printing machine defined by the embodiment mode of FIG. 4 comprises the following steps:

The printing modules of the pad printing machine are fitted with a special pad sable to remove the register marks on the printing plate during printing. Thereupon the pad printing machine's control unit is moved into an operational mode (startup) to measure and ascertain correction values.

The carriage is moved underneath a first printing module. The first printing module transfers the register marks from the printing plate to a startup plate or also to an object in the object support on the carriage.

Thereupon the carriage is moved underneath the optical inspection station where the image recorder takes a picture reference setup print image of the register marks and this reference setup print image is stored in the control unit. Next the image of the register marks is removed, for instance by wiping it off the startup plate, e.g., object.

Thereupon the carriage moves underneath a second printing module. The second printing module transfers the register marks from the printing plate to a startup plate, e.g., an object in the object support on the carriage.

Next the carriage is again moved underneath the optical inspection station where the image recorder takes a picture of the register marks. The image so produced is compared with the reference setup print image, as a result of which a deviation of the setup print image position from the reference setup print image is determined by the position deviation determining device.

On account of the data so obtained, the object carrier then may be moved into a print image delivery position representing that position wherein the said object is optimally located relative to the pad. The print image delivery position is determined from the shift of the reference position and from the deviation of the setup print image position from the position of the reference setup print image. This determination is implemented by the control unit which thereupon also shall appropriately drive the carriage and move it into a corrected print image transfer position. In alternative modes of implementation, such positioning may be manually carried out by an operator manually using a joystick or a keypad and visually comparing the reference setup print image and the setup print image and correcting the position. The correction values are stored in the control unit.

The step applied to the second printing module is repeated for all further printing modules.

After the correction values for all printing modules have been determined and stored, the pads are readied for printing. The carriage is moved underneath the first printing module and the object carrier position is changed using a keypad or joystick until a position corresponding to the desired print image position has been reached. When printing in the subsequent printing modules, said position is superposed on the particular stored correction values and in this manner the object in all printing modules shall be moved into the position also aligned with the other printing modules.

Even though the present invention was described above by means of fixed combinations of features, it nevertheless also covers the conceivable further advantageous combinations as they are defined in particular, but non-limiting manner in the dependent claims. All features disclosed in the application documents are claimed as inventive to the extent they are individually or in combination novel over the state of the art.

The invention claimed is:

1. A pad printing machine comprising at least one pad holder and a carrier for objects to be printed—hereafter "objects"—, this carrier being configured in positionally variable manner relative to a support that is part of the pad printing machine and being designed to receive one or more objects, wherein the pad printing machine further comprises a setup print image receiving element configured in a fixed position relative to the object carrier, an image recorder generating an image of at least one zone of the setup print image receiving element, a position deviation detector to detect the deviation of the actual position of a print image present on the print image receiving element relative to a reference position determined by reference data, and a position shift detector ascertaining the shift of the object carrier relative to a reference position.

2. Pad printing machine as claimed in claim 1, wherein the setup print image receiving element is fitted with a position marker/register mark.

3. Pad printing machine as claimed in claim 1, wherein the setup print image receiving element is made of glass.

4. Pad printing machine as claimed in claim 1, wherein the image recorder is a CCD camera or a video camera.

5. Pad printing machine as claimed in claim 1, wherein the image recorder is configured on a surface designed to receive the setup print image of the setup print image receiving element facing away from latter.

6. Pad printing machine as claimed in claim 1, wherein the object carrier is mounted in a fixed position relative to and on a multi-position table.

7. Pad printing machine as claimed in claim 1, wherein the setup print image receiving element is mounted at or in the object carrier or the/one multi-position table.

8. Pad printing machine as claimed in claim 1, wherein the setup print image receiving element is configured at or in a master object.

9. Pad printing machine as claimed in claim 1, wherein a component control unit comprises a joystick to manually position the object carrier or is designed to move the object carrier based on keypad inputs.

10. Pad printing machine as claimed in claim 1, wherein a print image on printing plates comprises special markings to position the print image, an ink cup inclusive a doctor blade being operated in controlled manner so that the ink cup selectively moves and scrapes over the print image or the special positioning markings.

11. Pad printing machine as claimed in claim 1, wherein the machine is configured to determine a print image application position of the object carrier based on the detected deviation and the ascertained shift.

12. A pad printing machine comprising:

at least one pad holder;

a support configured to support at least one printing plate;

a carrier configured to carry objects to be printed, the carrier being further configured in positionally variable manner relative to the support and to receive one or more of the objects;

a setup print image receiving element configured in a fixed position relative to the object carrier;

an image recorder configured to generate an image of at least one zone of the setup print image receiving element;

a position deviation detector configured to detect a deviation of the actual position of a print image present on the print image receiving element relative to a reference image; and a position shift detector configured to ascertain a shift of the object carrier relative to a reference position.

13. Pad printing machine as claimed in claim 12, wherein the machine is configured to determine a print image application position of the object carrier based on the detected deviation and the ascertained shift.

14. Pad printing machine as claimed in claim 13, wherein the machine is configured to at least indirectly drive the object carrier into the print image application position.

15. Pad printing machine as claimed in claim 12, wherein the machine includes a multi-position table configured for displacement in at least two axes, thereby displacing the object carrier.

16. Pad printing machine as claimed in claim 15, wherein the machine is configured to drive the multi-position table and thus the object carrier into a print image application position determined based on the detected deviation and the ascertained shift.

* * * * *